US006857156B1

(12) United States Patent
Grossman

(10) Patent No.: US 6,857,156 B1
(45) Date of Patent: Feb. 22, 2005

(54) MODULAR BRIDGE STRUCTURE CONSTRUCTION AND REPAIR SYSTEM

(76) Inventor: Stanley J. Grossman, 10408 Greenbriar Pl., Oklahoma City, OK (US) 73159

( * ) Notice: Subject to any disclaimer, the term of this patent is extended or adjusted under 35 U.S.C. 154(b) by 0 days.

(21) Appl. No.: 10/602,170

(22) Filed: Jun. 23, 2003

Related U.S. Application Data

(63) Continuation of application No. 09/543,466, filed on Apr. 5, 2000, now abandoned.

(51) Int. Cl.[7] ..... E01D 19/06; E01D 21/00

(52) U.S. Cl. ..... 14/73; 14/73.1; 14/74.5; 14/77.1

(58) Field of Search ..... 14/73, 74.5, 77.1; 52/223.7, 601

(56) References Cited

U.S. PATENT DOCUMENTS

| | | | | | |
|---|---|---|---|---|---|
| 2,382,761 | A | * | 8/1945 | Wilks | 52/506.09 |
| 3,675,385 | A | * | 7/1972 | Chan | 52/745.05 |
| 4,493,177 | A | | 1/1985 | Grossman | |
| 4,646,493 | A | | 3/1987 | Grossman | |
| 4,700,516 | A | | 10/1987 | Grossman | |
| 4,972,537 | A | | 11/1990 | Slaw, Sr. | |
| 4,991,248 | A | | 2/1991 | Allen | |
| 5,144,710 | A | | 9/1992 | Grossman | |
| 5,301,483 | A | | 4/1994 | Grossman | |
| 5,305,575 | A | | 4/1994 | Grossman | |
| 5,339,475 | A | | 8/1994 | Jaeger et al. | |
| 5,457,840 | A | * | 10/1995 | Derechin | 14/73 |
| 5,553,439 | A | | 9/1996 | Grossman | |
| 5,820,299 | A | | 10/1998 | Anderson | |
| 5,978,997 | A | * | 11/1999 | Grossman | 14/73 |
| 6,050,038 | A | | 4/2000 | Fey et al. | |
| 6,170,105 | B1 | * | 1/2001 | Doyle et al. | 14/73 |
| 6,170,209 | B1 | | 1/2001 | Dagher et al. | |
| 6,453,495 | B1 | * | 9/2002 | Meggers et al. | 14/73 |
| 6,588,160 | B1 | * | 7/2003 | Grossman | 52/223.7 |

* cited by examiner

*Primary Examiner*—Thomas B. Will
(74) *Attorney, Agent, or Firm*—McAfee & Taft

(57) ABSTRACT

A modular structure construction and repair system for use in new bridge construction and old bridge repair. The invention comprises a plurality of prefabricated modules which have a plurality of longitudinally extending beams and deck portions molded thereto. The modules are positioned over a plurality of girders so that longitudinal joints are formed above the girder. In the repair of an old bridge, an old section of the bridge deck is removed, and the modules are positioned on the existing girders. The modules are attached to the girders such that a shear connection is provided therebetween. Precompression may also be applied to clamp the sides of adjacent deck portions together. Various embodiments disclose this precompression and the shear connections.

64 Claims, 7 Drawing Sheets

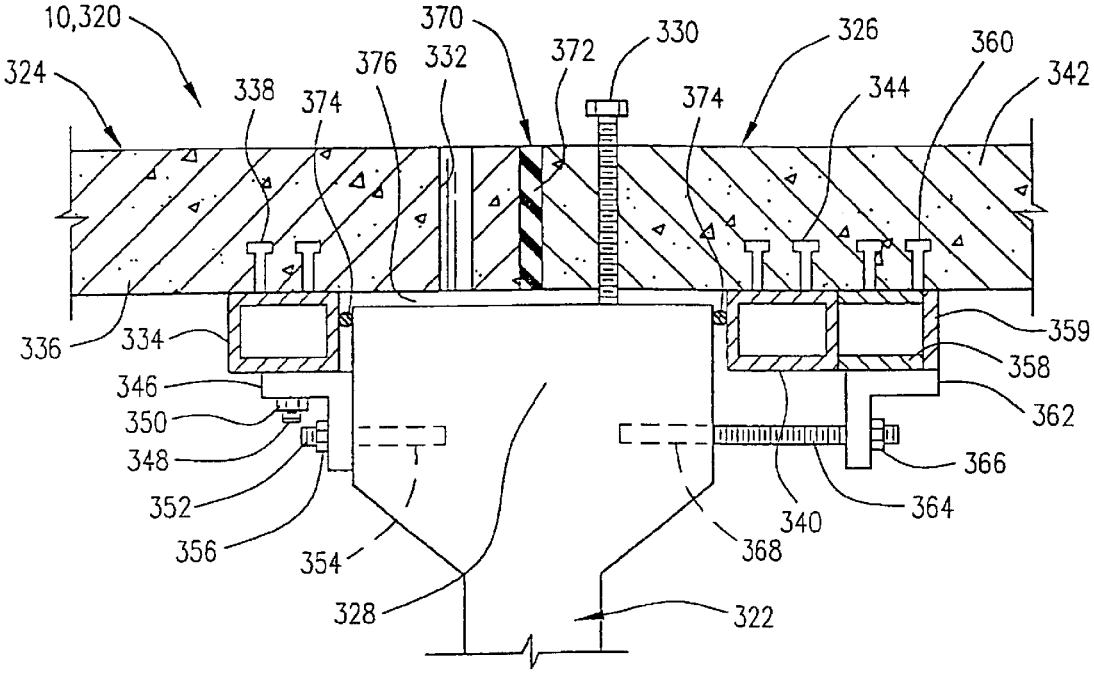
10,320
324
338
374
376
332
370
372
330
326
374
344
360
342
336
334
346
350
348
352
356
354
328
322
368
340
364
366
362
358
359
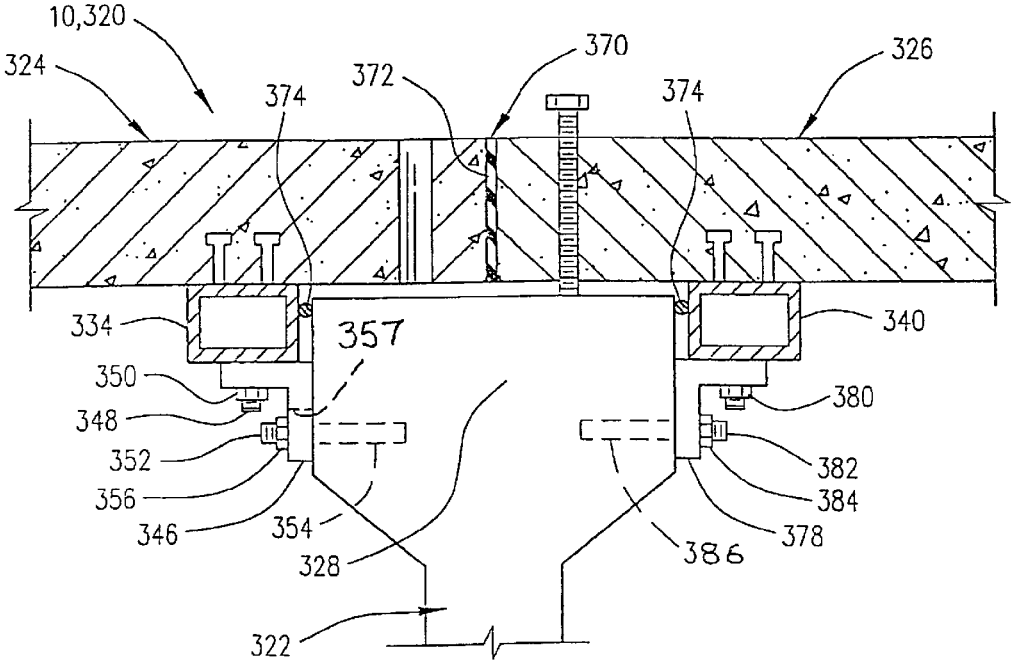
10,320
324
374
372
370
374
326
334
357
350
348
352
356
346
354
328
322
386
378
384
382
380
340

MODULAR BRIDGE STRUCTURE CONSTRUCTION AND REPAIR SYSTEM

This is a continuation of application Ser. No. 09/543,466, filed Apr. 5, 2000, now abandoned.

BACKGROUND OF THE INVENTION

1. Field of the Invention

This invention relates in general to concrete and steel composite structures, such as used in bridge construction and repair, and more particularly, to the use of modular composite structural members used in new construction and in the repair of old structures utilizing existing girders. The invention further relates to apparatus and methods for connecting longitudinal and transverse joints in such structures and making shear connections at such joints.

2. Description of the Prior Art

Large structures, such as bridges are well known and are obviously time-consuming to build or widen and even more time-consuming to rehabilitate. Typically, a bridge structure will have longitudinally extending girders with a concrete deck surface. The concrete deck surface is usually made composite with the girders by pouring the concrete in place around shear connectors connected to the girders.

To originally form such composite members of the type having an upper concrete surface and a metal or concrete support underneath, a mold typically is utilized. First, the steel or concrete supports, such as girders or beams, are placed beneath the mold assembly disposed around and supported by the supports. Next, concrete is poured into the mold such that the concrete fills the mold and extends over the girders or beams. When the concrete has hardened, the mold pieces are disassembled from around the support such that the concrete rests on the supports. In such instances, these types of structural members are formed in place. This is usually advantageous so the concrete deck surface can better fit into the finished structure. The concrete deck portion is attached to the girders by shear connectors which are molded into the concrete. This technique works satisfactorily in many cases, particularly in original bridge construction where the area of construction is readily accessible and speed of construction is not a concern.

In previous systems where separate prefabricated units are used, the sections are positioned adjacent to one another upon support members for those sections, such as girders or beams, which have been positioned on the piers or abutments. This technique is particularly useful when it is not feasible to form the entire structure in place or when the use of prefabricated members can save construction time on site. It also works well in bridge widening projects where prefabricated members are installed next to the existing structure.

Certain construction restraints, such as those in which a bridge structure is being repaired or otherwise refurbished or rehabilitated, make many prior art methods of construction more expensive and result in associated problems, such as traffic delays. In repair or refurbishing, typically the old concrete deck, or at least a part of it, is removed, and another deck must be put in its place. If the replacement deck must be poured in place, molds must be set up, the concrete poured, and then the concrete allowed time to cure before the bridge structure can be reopened to traffic. In high density traffic areas, this creates considerable traffic tie-up problems, which result in significant lost time and inconvenience to commuters and other travelers.

The use of prefabricated composite units which can be set in place, such as those described above, greatly reduces the repair time involved. That is, the old structure may be removed, and the new structure simply set in place on the piers or abutments and attached to them. Because of the prefabrication, the time necessary to construct molds, pour concrete and allow the concrete to cure can all occur prior to the placement of the composite units. Thus, the "down time" to repair the bridge structure is greatly reduced, which lowers costs and pleases motorists. However, this technique creates longitudinal and transverse joints that need to be properly made so that the upper road surface is smooth and without misaligned upper surfaces. Also, it is important that the longitudinal and transverse joints be filled so that they do not become potential pathways for water and salt-laden water to fall objectionably on other parts of the structure.

The present invention all but eliminates this objectionable leakage without adding construction time to a constrained time window, such as occurs in overnight construction. Because the modular units or modules can be attached quickly, they can carry traffic very soon after they are placed in position. In the present invention, prefabricated composite modules are still positioned adjacent to one another, forming longitudinal and transverse joints therebetween. One of the adjacent modules is pulled and clamped to the other by a precompression technique which holds the adjacent modules together. A shear connection is made between the adjacent units and with the corresponding existing girder over which the longitudinal joint between the modules extends. Leveling bolts are utilized to level adjacent concrete deck portions of the modules so that upper surfaces thereof are level prior to final connections.

The joints may be filled with a sealant applied to the abutting faces of the joints before they are pulled together. Whether used with match-cast, abutting faces or a conventional, hardened, grout-filled joint, precompressing the joint has the advantage of creating an extremely watertight joint and, at the same time, supplementing the tensile resistance of the joint adhesive with precompressive stresses.

One conventional approach to precompressing bridge structures is to install conduit in the deck portions thereof which is accomplished by positioning the conduit and pouring the moldable material around it. Steel cables are installed in these conduits after the bridge structure is erected and compression applied to the structures in a transverse direction by post-tensioning the steel cables. This process has several problems, one of which is the difficulty of aligning the conduits during the erection of the bridge structure. Further, there is a potential for damaging both the cable and its protective coating when the cable is pulled through misaligned conduit. Additionally, any such damage may result in future deterioration which is not visible and can lead to unexpected and sudden failure. In the present invention, any future deterioration of the precompressive components is readily visible and more easily corrected than with hidden and buried cable. Further, the present invention provides easy disassembly of the structure when future repair and/or rehabilitation is required, thus even further speeding up the rehabilitation time. Finally, due to the cost and extensive time of installation, splices of conventional post-tensioning are usually avoided. Thus, full roadway width installation is required, whereas the present invention allows as little as beam-to-adjacent-beam installation. The latter provides a substantial advantage over full-width installation in that only a portion of the traffic capacity is disabled instead of all of it.

SUMMARY OF THE INVENTION

The present invention provides a modular bridge structure which may be used in the construction of new bridges and also used in the repair of existing bridges. The invention utilizes modular composite structural members which may be placed on new or existing girders to provide a fast and efficient construction or repair process. The invention may be used with either steel or concrete girders, and preferably utilizes modules which are cast in an inverted position to produce high longitudinal compression at the centerline of the modules. In this way, by centering, say, a fifty-foot-long piece-at a pier on a continuous girder below the modules, composite action is obtained for a negative moment.

Generally, the present invention may be described as a structural member for use on structural supports, such as piers or abutments. The structural member comprises a plurality of longitudinally extending girders, which may either be new girders for new construction or existing girders in repairing old structures, and a plurality of composite deck modules. Each module comprises a plurality of longitudinal beams extending substantially parallel to the girders, and a deck portion made of a moldable material attached to the beams. Longitudinally extending sides of adjacent deck portions face one another and are positioned above a corresponding one of the girders. The structural member further comprises connecting means for connecting the adjacent deck portions to the girders and thereby forming a shear connection therebetween.

The apparatus may further comprise leveling means for leveling upper surfaces of the deck portion. The leveling means is preferably characterized by a bolt engaged with an insert disposed in the deck portion. The leveling bolt is adapted for engaging the girder whereby the deck portion may be raised above the girder such that a gap is defined therebetween. The deck portion also defines a grouting opening through which grout may be poured to fill the gap. The gap is sealed between the girders and beams to contain grout poured therein.

The connecting means may comprise a plate disposed adjacent to the girder in one of the beams, and fastening means for attaching the plate to the beam and the girder. In one embodiment, the plate is characterized by an angled member having a pair of legs, and the fastening means comprises a fastener interconnecting one of the legs and the tube and another fastener interconnecting the other of the legs and a flange of the girder. In another embodiment, the plate is substantially flat, and the fastening means is characterized by a fastener interconnecting the plate and the tube and another fastener interconnecting the plate and the girder. With the flat plate, a spacer may be disposed between the plate and the flange of the girder. In still another embodiment, the connecting means may comprise a plurality of bolts, such as epoxy-drilled bolts, extending through the flange of the girder into the deck portion thereabove.

The structural member may further comprise precompression means for clamping the sides of the adjacent deck portions together. In a first embodiment, the precompression means comprises a plate attached to the girder, a short transverse tube disposed adjacent to one of the longitudinal tubes and connected to the deck portion, and a fastener interconnecting the plate and the short tube. This plate may be an angled member having a pair of legs wherein the fastener extends through one of the legs. The precompression means may further comprise another angled member having a pair of legs wherein one of the legs on this other angled member is attached to the short tube and the fastener is attached to the other legs on both angled members.

In another embodiment, the precompression means may comprise short transverse tubes adjacent to longitudinal tubes on opposite sides of the corresponding girder and connected to the deck portion, and a fastener disposed through the short tubes, longitudinal tubes and the hole defined in the girder.

In still another embodiment, the girder is concrete and has upper and lower flanges molded therein. In this embodiment, the connecting means comprises a plate disposed adjacent to the girder and one of the beams, and fastening means for attaching the plate to the beam and the girder. The plate may be characterized by an angled member having a pair of legs, and the fastening means may comprise a fastener interconnecting one of the legs and the tube and another fastener interconnecting the other of the legs and the upper flange of the girder. The fastener may be a bolt engaged with an insert disposed in the upper flange of the girder. This insert may be cast in during manufacture of the girder or positioned therein subsequently. Alternatively, the bolt may be an epoxy-drilled bolt.

In the embodiment using a concrete girder, the precompression means may comprise a short transverse tube disposed adjacent to one of the longitudinal tubes and connected to the deck portion, a plate attached to the short tube, and a fastener interconnecting the plate and the girder. The plate may be an angled member having a pair of legs, one of the legs being attached to the short tube, and the fastener means may comprise an all-thread rod engaged with an upper flange of the girder and a nut threadingly engaged with the all-thread rod and further engaged with the other leg of the angled member. The all-thread rod may be threadingly engaged with an insert disposed in the upper flange of the girder. Again, this insert may be cast in or added subsequently. Alternatively, an epoxy-drilled bolt may be used.

The structural member further comprises transverse connecting means for connecting transversely extending sides of facing deck portions of adjacent modules to form a transverse joint therebetween. The transverse connecting means may comprise a plate disposed on one of the adjacent beams of the adjacent modules, another plate disposed on the other of the adjacent beams of adjacent modules, and fastening means for interconnecting the plates. In one embodiment, the plates are angled members, and the fastening means comprises a bolt disposed through facing legs of the angled members.

For the girder nearest the side of the overall structure, the module has a different construction which does not include a joint above the girder. In this portion of the overall structure, the invention may be described as a structural member comprising a longitudinally extending girder, and a composite deck module which comprises a plurality of longitudinal beams extending substantially parallel to one another and to the girder, and a deck portion made of a moldable material attached to the beams such that beams are disposed on opposite sides of the girder. The member may further comprise connecting means for connecting the deck portion to the girder and thereby forming a shear connection therebetween.

For this side connection, the connecting means comprises a plate disposed adjacent to one of the beams and the girder, and another plate disposed adjacent to the other of the beams and the girder, and fastening means for connecting the plates to the girder and the corresponding longitudinal beams. Again, a leveling means, such as a leveling bolt threadingly engaged in an insert in the deck portion and engaging an upper surface of the girder may be used so that the deck portion may be raised above the girder so that a gap is defined therebetween. As previously described, the gap is subsequently filled with high-strength grout.

The present invention may be further described as a method of repairing a bridge structure having a bridge deck supported by a plurality of girders comprising the steps of (a) fabricating a plurality of composite modules, each module comprising a plurality of substantially parallel longitudinal beams and a deck portion made of a moldable material and attached to the beams, (b) removing an old section of the bridge deck from an area above one of the girders while leaving the girder in place, (c) positioning at least one of the modules in the area to replace the old section such that the beams extend longitudinally and substantially parallel to the girder, and (d) clamping facing longitudinal sides of adjacent deck portions of adjacent modules together such that a precompressed joint is formed between the adjacent deck modules. Preferably, step (a) comprises prefabricating the modules in an inverted position, but the invention is not intended to be so limited.

Prior to step (d), the method may comprise the step of placing an adhesive between the facing longitudinal sides of the adjacent deck portions. Step (a) may further comprise forming one of the deck portions with a longitudinally extending groove defined in the side thereof and another deck portion with a tongue thereon adapted for extending into the groove after step (d) such that upper surfaces of the adjacent deck portions are held substantially aligned. Adhesive may be placed in this groove.

In the method, step (a) may comprise fabricating the deck portions with a plurality of leveling bolts disposed therein such that the leveling bolts are adapted for engaging an upper surface of the girder when the deck portions are placed in the area, and thus, the method may further comprise, prior to step (b), using the leveling bolts to level upper surfaces of the deck portions such that all of the deck portions are substantially aligned. Step (a) may comprise casting the threaded inserts in the deck portions during construction of the deck portions.

The step of leveling generally causes a gap to be defined between the adjacent deck portions and the corresponding girder, and step (a) may comprise fabricating the deck portions with a plurality of grouting openings therein and further comprise the step of (e) filling the gap with a high-strength grout through the grouting openings. Prior to step (e), the method may further comprise sealing between the girder and the beams adjacent thereto for substantially sealingly closing the gap and containing the grouting material therein.

The method may additionally comprise the step of attaching adjacent longitudinal beams of adjacent modules along a transverse joint therebetween. The method may further comprise connecting the beams to the girder such that a shear connection is formed therebetween.

Numerous objects and advantages of the invention will become apparent as the following detailed description of the preferred embodiment is read in conjunction with the drawings illustrating such embodiment.

BRIEF DESCRIPTION OF THE DRAWINGS

FIG. 8 is a cross-section of a third embodiment taken along lines 4—4 in FIG. 1.

FIG. 9 shows a cross-section of the third embodiment taken along lines 5—5 in FIG. 1.

FIG. 10 is a cross-section taken along lines 10—10 in FIG. 1 and shows connection of a transverse joint.

FIG. 11 is a cross-section of a fourth embodiment taken along lines 4—4 in FIG. 1 in which the support girder is concrete.

DESCRIPTION OF THE PREFERRED EMBODIMENTS

The present invention relates to composite structures, such as bridges and is adapted for use in new construction, refurbishment or repair of old structures, and widening of existing structures. The refurbishment of an existing structure is described, but the technique and apparatus are the same for new construction.

Figure 1:
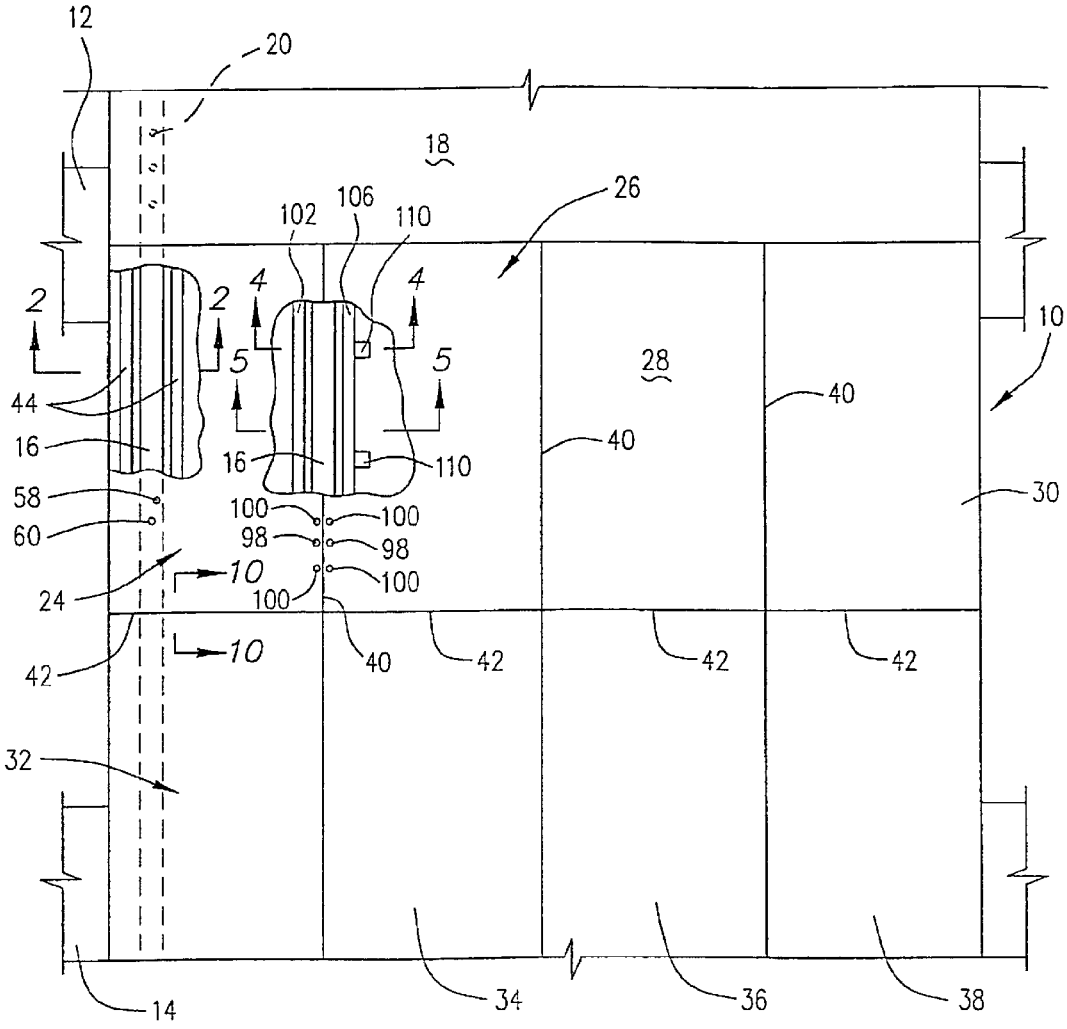
FIG. 1 is a plan view of a bridge structure utilizing the modular bridge structure construction and repair system of the present invention.

Referring initially to FIG. 1, the modular bridge structure connection and repair system of the present invention is shown utilized in an overall structure in the form of a bridge, generally designated by the numeral 10. Bridge 10 is adapted for extending between a pair of structural supports 12 and 14, such as abutments or piers. Of course, additional structural supports may be provided in a typical bridge.

Original bridge 10 comprises a plurality of longitudinally extending girders 16, which generally have an I-bean configuration. Girders 16 are positioned on structural supports 12 and 14.

Disposed above girder 16 is an existing molded deck portion 18, which is made of a moldable material, such as concrete. Extending upwardly from the top of girder 16 is a plurality of shear connectors 20 of a kind known in the art. Shear connectors 20 are fixedly attached to the top of girders 16 and extend upwardly therefrom in a known manner. Deck portion 18 is formed and placed on girders 16 such that the molded material forming the deck portion is molded around shear connectors 20, thus forming a locking attachment between the deck portion and girders. Once the molded material has hardened, a composite structure is formed.

Using prior techniques, when it is time to repair or refurbish prior art bridge 10, the area of deck portion 18, which is to be replaced, is removed. What is especially difficult to remove is the concrete around and in between shear connectors 20. Inevitably, many of these shear connectors are damaged and have to be replaced.

If a section is removed and is to be replaced by conventional methods, a mold (not shown) must be formed in the area where the old section was and the mold filled with new hardenable material. The material must harden so that a new composite structure is formed. During this process, it will be necessary to reposition new reinforcing material so that it will also be integral with the final structure within the concrete. All of this is a very time-consuming process, and results in a portion of the bridge being repaired or refurbished being out of commission to traffic for a significant period of time including while the concrete cures. In some locations, this simply creates too large a burden on traffic flow to be acceptable. Also, in this process (as mentioned above), some or all of shear connectors 20 in the area to be refurbished may be inadvertently removed or damaged such that subsequent removal is necessary. This requires that new shear connectors 20 be attached which, again, undesirably increases the time the bridge is out of use.

Modular construction may be utilized in repairing or also widening a bridge structure without the necessity of positioning new molds and pouring new concrete in place. When modular units are used, the section of deck portion 18 which is to be replaced, is removed, and replaced with a prefabricated module. Because the module is prefabricated, it can be immediately set in place after removal of the corresponding deck portion. Still referring to FIG. 1, eight prefabricated modules 24, 26, 28, 30, 32, 34, 36 and 38 are shown. The intersection of these modules defines a plurality of longitudinal joints 40 and transverse joints 42. Obviously, depending on the size and shape of the bridge, any number of modules may be used with a corresponding number of longitudinal joints 40 and transverse joints 42 defined therebetween.

Such modules 24–38 are easily and quickly positioned on girders 16 so that the amount of time that bridge 10 is out of use is greatly reduced from the older, more conventional method of pouring in place. However, because the modules are not originally interconnected, they must be attached to one another and to girders 16.

Figure 2:
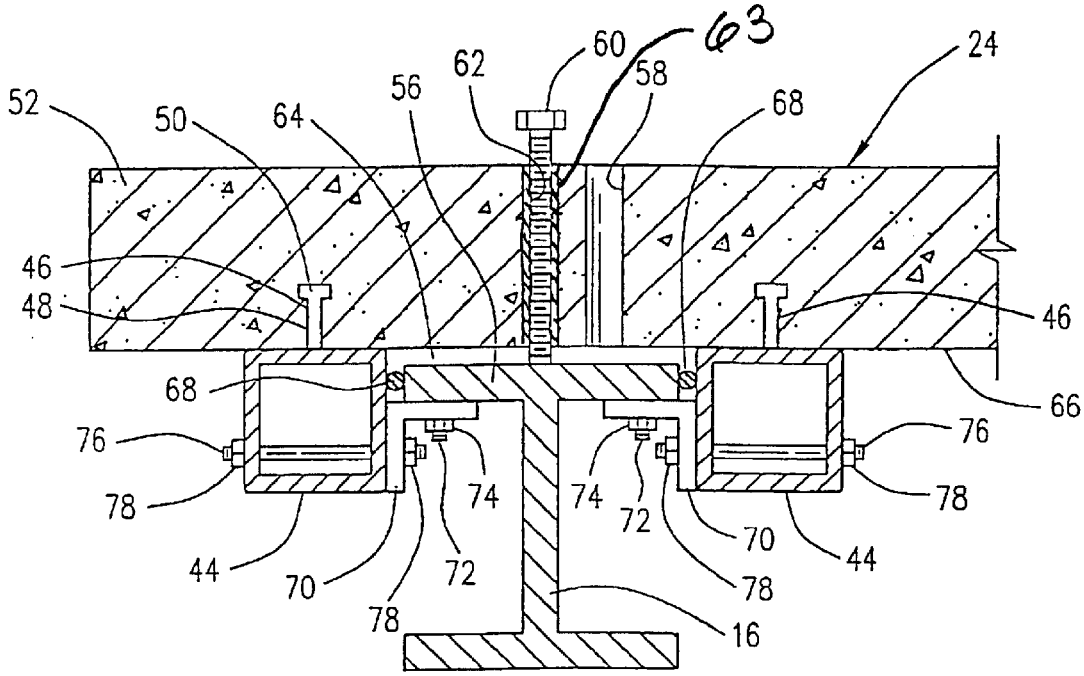
FIG. 2 is a cross-section taken along lines 2—2 in FIG. 1 showing one embodiment of a connection of a side module attached to an outer girder.
Figure 3:
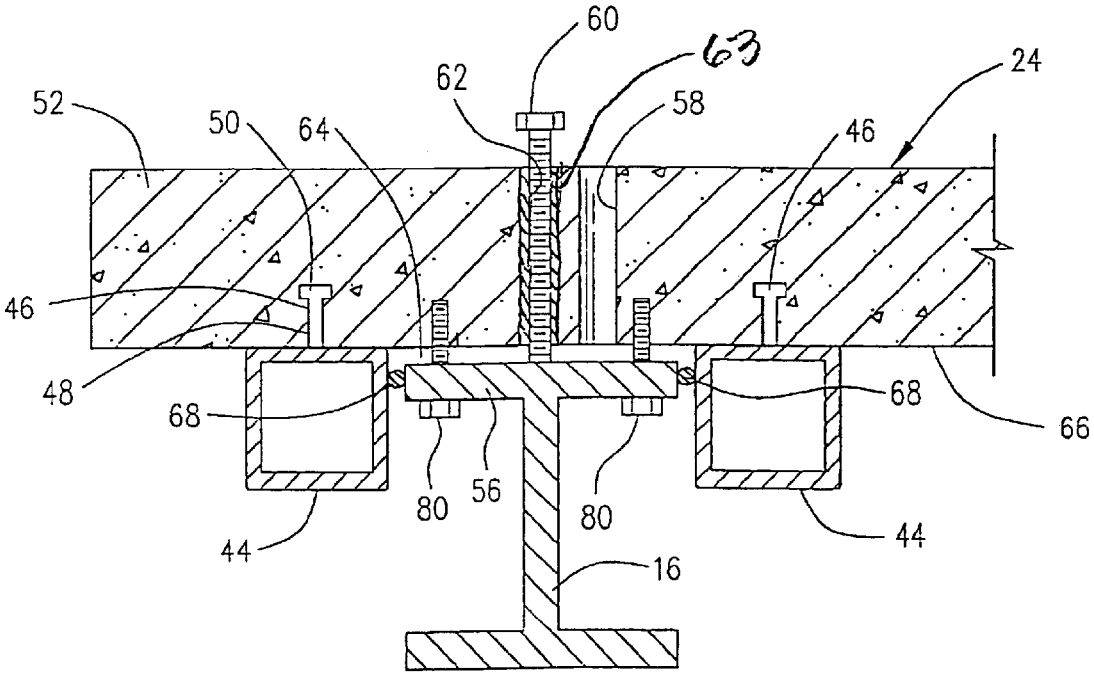
FIG. 3 is another cross-section taken along lines 2—2 in FIG. 1 and illustrating an alternate embodiment of the connection of a side module.

Referring now also to FIGS. 2 and 3, outermost side module 24 will be shown and described. The general description of the other modules 26–38 is very similar. Module 24 comprises a plurality of longitudinally extending steel beams or members 44 which extend substantially the entire length of each module 24. Steel members 44 are preferably of tubular construction and therefore may also be referred to as longitudinal tubes 44.

Extending upwardly from the top of each longitudinal tube 44 is a plurality of shear connectors 46. Shear connectors 46 are fixedly attached to the tops of tubes 44. Each shear connector 46 has a shank portion 48 with an enlarged head 50 at the outer end thereof, but other kinds of connectors generally known in the art may also be used.

Module 24 further comprises a molded deck portion 52. Deck 52 is made of concrete or similar material and is molded around shear connectors 46 on tubes 44 to form a composite structure after the concrete hardens. Preferably, but not by way of limitation, deck 52 is molded such that it is prestressed in a manner wherein upper surface 50 of the deck is placed in compression at least in the direction of longitudinal tubes 44 when in the operating position shown in the drawings.

One method of forming modules, such as module 24, is that described in U.S. Pat. Nos. 4,493,177, 4,646,493, 4,700,516, 5,144,710, 5,301,483, 5,305,575 and 5,553,439, copies of which are incorporated herein by reference. Those patents show I-beams rather than tubes, but the general construction is the same. Using this method, modules 24–38 are constructed in an inverted position such that longitudinal tubes 44 and the mold for forming deck 52 have downward deflection. The mold is filled with the moldable material, such as concrete, which hardens to form a composite structural member with tubes 44. During placing of the moldable material, the mold is deflected so that tubes 44 are placed in a stressed condition to form a composite, prestressed structural member upon hardening of the moldable material. Once hardening has occurred, the module is inverted. When inverted and supported on girders 16, the center portion of the structure deflects downwardly due to its own weight so that the hardenable material is substantially always in compression in the direction of longitudinal tubes 44. Thus, the resulting modules have been beneficially prestressed since deck 52 thereby resists cracking. Regardless of the actual molding process for forming modules 24–38, these modules are positioned as shown in FIG. 1.

Referring still to FIG. 2, a first embodiment of the assembly and connection of side module 24 to outermost girder 16 is shown. The outermost portion of module 24 has a pair of longitudinal beams 44 which straddle upper flange 56 of girder 16 when module 24 is installed. Deck portion 52 of module 24 has a plurality of longitudinally spaced grout openings 58 therein which are disposed above upper flange 56 of girder 16. Deck portion 52 also has a plurality of longitudinally spaced leveling bolts 60 disposed in corresponding threaded holes 62. Holes 62 may be defined in threaded inserts 63 cast in deck portion 24. Leveling bolts 60 are also positioned above upper flange 56 of girders 16.

Module 24 is set into place as shown in FIG. 2, and leveling bolts 60 are used to position upper surface 54 of deck portion 52 to the desired level, such as level and even with an adjacent portion of the old bridge deck or level with an adjacent module, such as module 32. This will generally form a gap 64 between upper flange 56 of girders 16 and lower surface 66 of deck 52. Grout is poured into grout openings 58 which will fill gap 64. A seal 68 such as a strip of backer rod foam, may be placed as further described herein to seal gap 64 so that the grout will not run out.

After the grout in grout openings 58 and gap 64 has hardened, leveling bolts 60 are removed, and threaded holes 62 are also filled with grout.

A shear connection is made between girders 16 and module 32 by an angled member 70. A horizontal leg of angle 70 is attached to upper flange 56 of girder 16 by a threaded stud 72 welded to flange 56 and a nut 74. A vertical leg of angle 70 is attached to an adjacent longitudinal tube 44 by all-thread rod 76 and nuts 78.

FIG. 3 shows an alternate embodiment of attachment of a module to an outermost girder 16. Rather than using an angle, an epoxy-drilled bolt 80 is positioned through upper flange 56 of girder 16 and field-drilled into deck portion 52. The other features of this connection are identical to that shown in FIG. 2. The embodiment of FIG. 2 is usually preferable because drilled bolts 80 are difficult to remove for later repair or replacement.

After module 24 has been installed, an adjacent module, such as module 26, can be installed. The installation of module 26 adjacent to module 24 and the connection of these two modules to the corresponding girder 16 therebelow is typical of the other modules forming longitudinal joints 40. Three different embodiments of this connection are shown, but it should be understood that there are many variations of these embodiments, and the invention is not intended to be limited to the specific three illustrated.

First Embodiment

Figure 4:
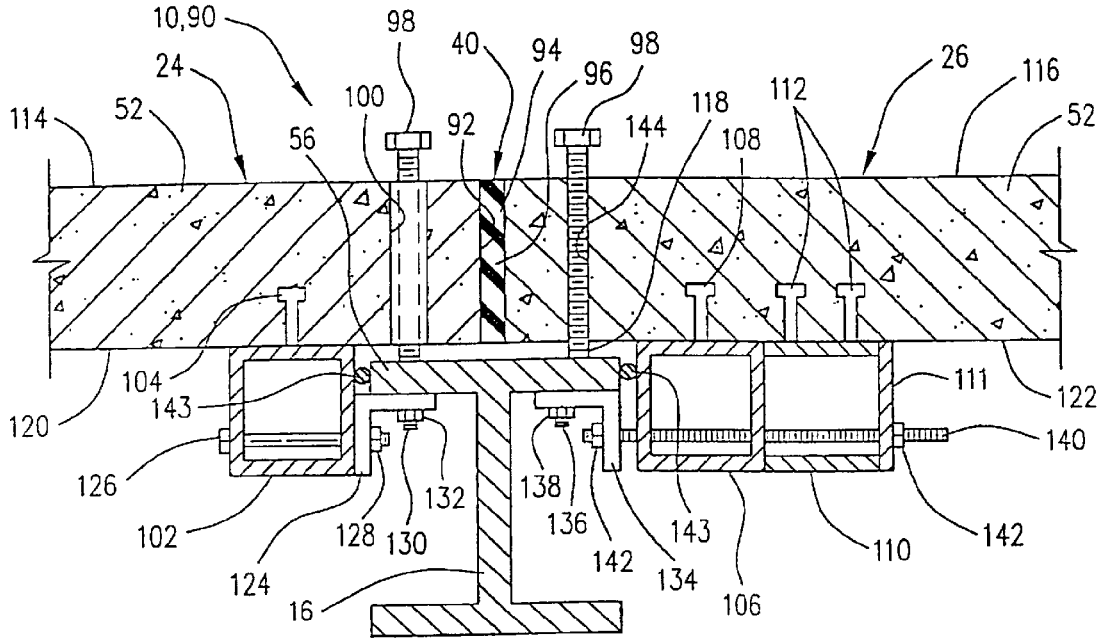
FIG. 4 is a cross-section taken along lines 4—4 in FIG. 1 of a first embodiment of the modular bridge structure showing a longitudinal joint with the precompression apparatus.
Figure 5:
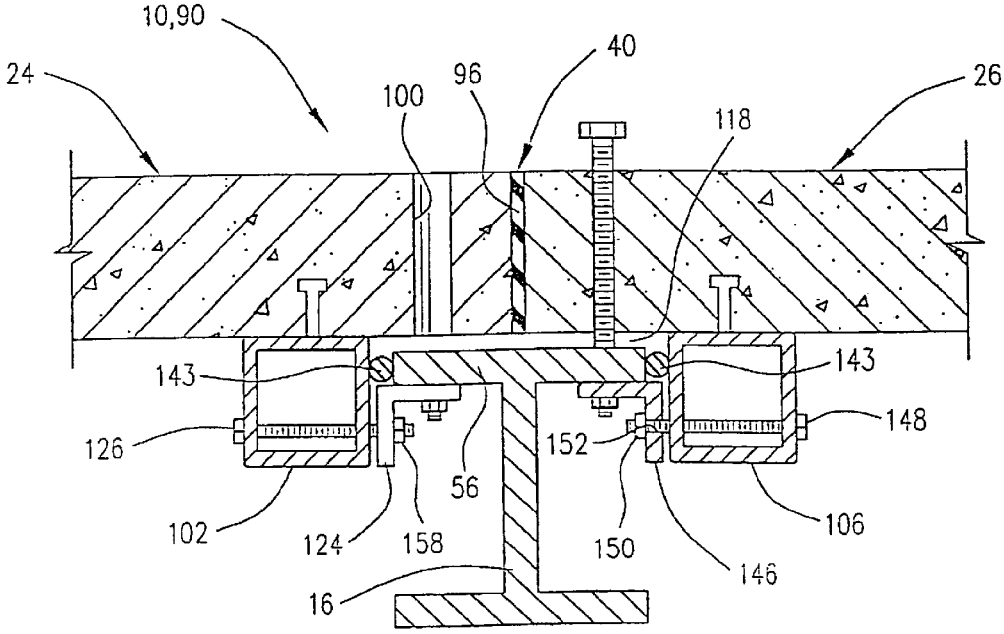
FIG. 5 is a cross-section of the first embodiment taken along lines 5—5 in FIG. 1 spaced away from the precompression apparatus.

The first embodiment is shown in FIGS. 4 and 5 and is generally designated by the numeral 90. As will be further discussed herein, FIG. 4 shows the installation of modules 24 and 26 and further illustrates precompression assembly thereof. A shear connection between modules 24 and 26 and girders 16 is also shown. FIG. 5 shows additional shear connections at different locations longitudinally along girders 16 at which precompression is not applied. In other words, the precompression assembly components are not required for every shear connection.

Referring now in detail to FIG. 4, modules 24 and 26 have facing longitudinally extending sides 92 and 94 respectively. When sides 92 and 94 are positioned over girder 16 by using leveling bolts 98, sides 92 and 94 which form joint 40 are coated with a quantity of an epoxy adhesive 96 and the all-thread rods 140 are used to squeeze sides 92 and 94 tightly together. Leveling bolts 98 may be disposed in threaded inserts (not shown) similar to previously described inserts 63.

Each of modules 24 and 26 has a plurality of longitudinally spaced leveling bolts 98 near sides 92 and 94. Also, each of modules 24 and 26 has a plurality of longitudinally spaced grouting openings 100 defined therein.

Module 24 has a longitudinally extending beam or steel member, preferably in the form of a longitudinal tube 102, attached to deck portion 52 by a plurality of shear connectors 104. Similarly, module 26 has a longitudinally extending beam or steel member, preferably in the form of a longitudinal tube 106, attached to deck portion 52 thereof by a plurality of shear connectors 108.

A relatively short, transversely extending tube 110 is positioned adjacent to longitudinal tube 106 and preferably attached thereto, such as by welding. Transverse tube 110 is also connected to deck portion 52 of module 26 by a plurality of shear connectors 112 and has its open end closed with a closure plate 111 attached thereto, such as by welding.

An angled member 134 is attached to upper flange 56 of girder 16 by a threaded, welded stud 136 and a nut 138.

Angled member 134 is also attached to transverse tube 110 by a horizontally disposed all-thread rod 140 and a pair of nuts 142. When everything is positioned as shown in FIG. 4, one of nuts 142 is tightened on all-thread rod 140 to force module 26 toward module 24. This will compress epoxy adhesive 96 in joint 40. When modules 24 and 26 are thus relatively positioned as desired, a seal, such as foam backer rod 143, is used to seal gap 118 between angle 124 and tube 102 and between angle 134 and tube 106. Gap 118 and grouting openings 100 are filled with a high-strength grouting material poured into openings 100. After the grout hardens, leveling bolts 98 are removed, and bolt holes 144 are also filled with grout.

During assembly, modules 24 and 26 are positioned as shown, and the joint 40 therebetween filled with epoxy adhesive 96 as previously described. Leveling bolts 98 are utilized to make upper surface 114 of module 24 and upper surface 116 of module 26 flush with one another, thus creating a gap 118 between lower surfaces 120 and 122 of modules 24 and 26, respectively, and girder 16. The attachment of tube 102 to girder 16, whether done with module 24 installed by itself or with module 26, is accomplished by another angled member 124 which is attached to tube 102 by a fastening means, such as a bolt 126 and nut 128. Angled member 124 is attached to girder 16 by a threaded, welded stud 130 and a nut 132. Threaded stud 130 is preferably gun-welded to upper flange 56 of girder 16.

Nuts 128 and 132 are tightened, and it will be seen that these tightened connections make a shear connection between girder 16 and tube 102.

Referring now to FIG. 5, the connections between modules 24 and 26 with girder 16 are shown not including the precompression assembly. The connection of module 24 with girder 16 in FIG. 5 is identical to that in FIG. 4. The connection of module 26 in FIG. 5 is basically a mirror image of that for module 24. That is, tube 106 of module 26 is attached to upper flange 56 of girder 16 by an angled member 146, a bolt 148 and a nut 150. Angled member 146 is attached to girder 16 by threaded welded stud 136 and a nut 138. Threaded stud 136 is gun-welded to upper flange 56 of girder 16.

In this and other embodiments, it is preferred for new construction to install all of the modules and then level them with the leveling bolts. Then, the described shear connections are made.

Second Embodiment

Figure 6:
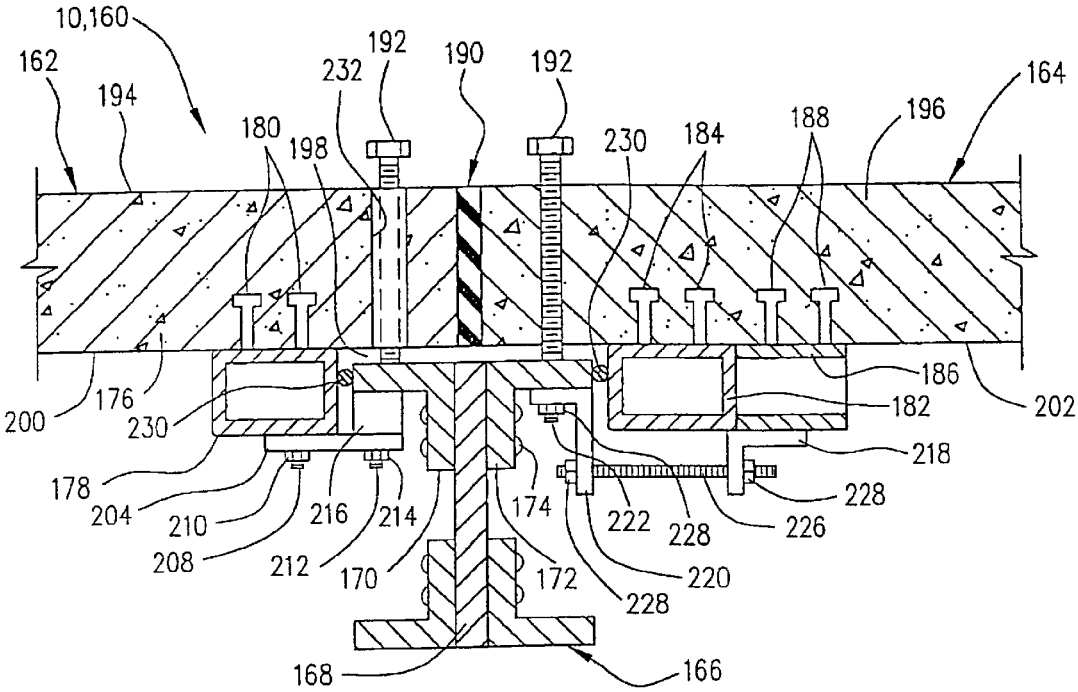
FIG. 6 shows a cross-section of a second embodiment of the invention taken along lines 4—4 in FIG. 1.
Figure 7:
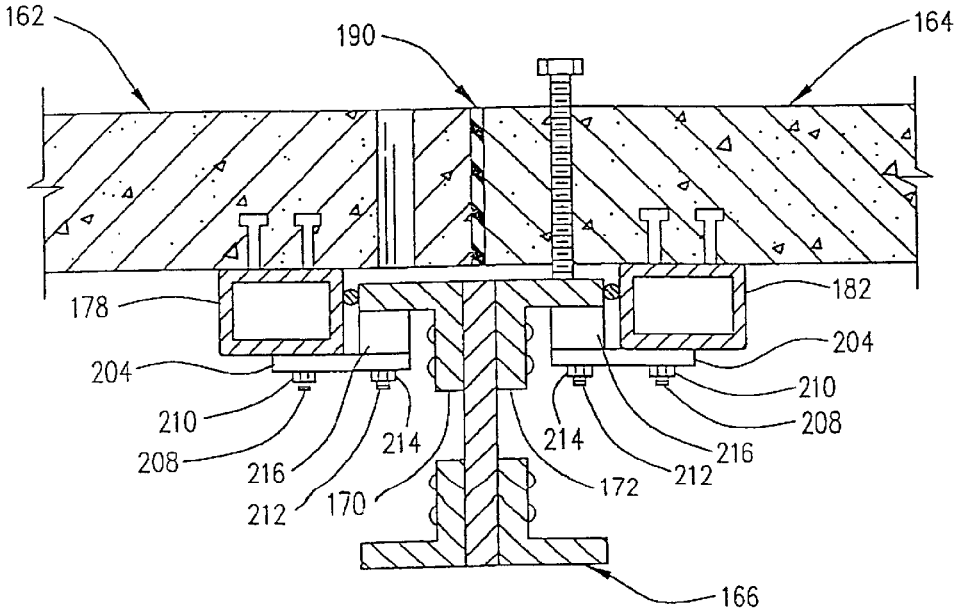
FIG. 7 illustrates a cross-section of the second embodiment taken along lines 5—5 in FIG. 1.
Figure 5:
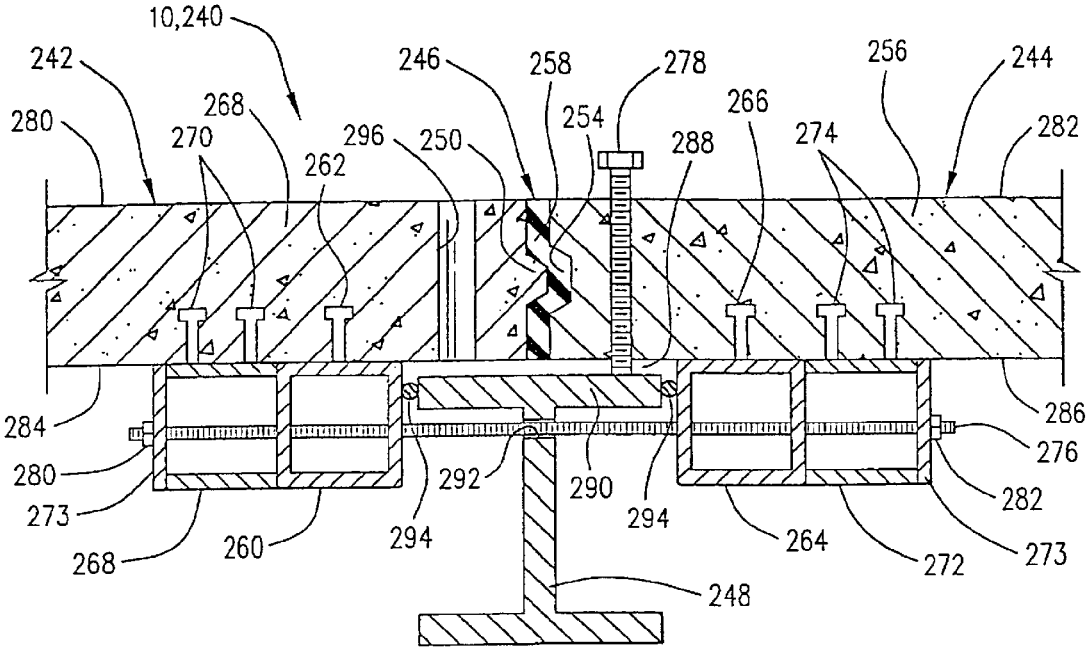
Figure 6:
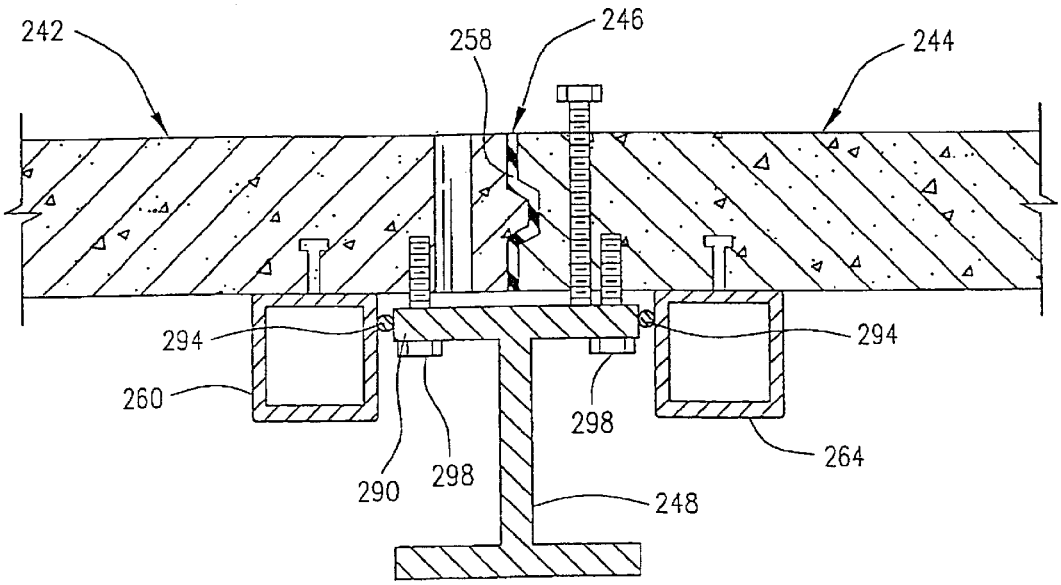

Referring now to FIGS. 6 and 7, a second embodiment of the modular bridge structure of the present invention is shown and generally designated by the numeral 160. Second embodiment bridge 160 is different in configuration in some respects from first embodiment 90, but performs in basically the same manner.

Second embodiment bridge 160 comprises modules 162 and 164 which are installed on a girder 166. Girder 166 is illustrated as an old-style, fabricated girder having a vertical web 168 and a pair of upper flanges 170 and 172 which are attached to web 168 by a plurality of rivets 174. This old-style girder construction is shown for illustrative purposes only, and the second embodiment is not intended to be limited to such a girder. The previously described girder 16 could also be used as will be seen by those skilled in the art.

Modules 162 and 164 arc constructed in a manner similar to those previously described. For example, module 162 comprises a deck portion 176 and a longitudinally extending beam or steel member, such as a longitudinal tube 178 connected to the deck portion by a plurality of shear connectors 180. Similarly, module 164 has a deck portion 176 and a longitudinally extending tube 182 connected to deck portion 176 by a plurality of shear connectors 184. A short transversely extending tube 186 is positioned adjacent to tube 182 and preferably attached thereto, such as by welding. Short tube 186 is connected to deck portion 176 of module 164 by a plurality of shear connectors 188.

During construction, modules 162 and 164 are positioned so that a joint 190 therebetween is positioned over the center of girder 166. Leveling bolts 192 are disposed in each module and are used to level upper surfaces 194 and 196 of modules 162 and 164 respectively in the manner previously described for first embodiment 90. This forms a gap 198 between lower surfaces 200 and 202 of deck portions 176 of modules 162 and 164, respectively, and the top of girder 166. Leveling bolts 192 may be disposed in threaded inserts (not shown) as previously described.

Short tube 186 has an angled member 218 fixedly attached thereto, such as by welding. Another angled member 220 is attached to upper flange 172 by a threaded stud 222 gun-welded to upper flange 172 and a nut 224.

A precompression connection is made between girder 166 and module 164 by an all-thread rod 226 and a pair of nuts 228 which are used to interconnect angled members 218 and 220 as seen in the right side of FIG. 6. By tightening one of nuts 228, module 164 is moved toward module 162 closing joint 190 and compressing the epoxy adhesive material that has been applied to the faces of joint 190. Once this precompression is done, a seal, such as a foam backer rod 230, is disposed between longitudinal tube 178 and upper flange 170 and also between longitudinal tube 182 and upper flange 172 to sealingly close gap 198. High-strength grouting material is poured into gap 198 through grouting openings 232 and allowed to harden. Leveling bolts 192 are removed and threaded openings 234 also filled with grout. If module 162 has already been set, only the right half of FIG. 6 needs to be installed.

A flat plate 204 is used to form a shear connection between longitudinal tube 178 and upper flange 170 as seen in the left side of FIG. 6. Threaded studs 208 are gun-welded to longitudinal tube 178, and nuts 210 are used to connect plate 204 to tube 178. Other threaded studs 212 are attached to upper flange 170, and nuts 214 are used to connect flat plate 204 to upper flange 170. A spacer 216 may be positioned between plate 204 and upper flange 170 as necessary.

Referring now to FIG. 7, shear connections are illustrated between girder 166 and modules 162 and 164 at a location spaced away from the precompression assemblies shown in FIG. 6. The connection of module 162 to girder 166 at this location is identical to that shown in FIG. 6. In FIG. 7, the connection of module 164 to girder 166 at that location is simply a mirror image of that for module 162. That is, another flat plate 204 is used to connect upper flange 172 with longitudinal tube 182 through the attachment provided by threaded welded studs 208, nuts 210, threaded welded studs 212 and nuts 214. Again, a spacer 216 may be used between plate 204 and upper flange 172 as necessary.

Third Embodiment

A third embodiment is shown in FIGS. 8 and 9 and generally designated by the numeral 240. In this embodiment as illustrated, two prefabricated modules 242 and 244 are shown forming a joint 246 above a girder 248. Girder 248 may be identical to either girder 16 or girder 166 previously described for the first two embodiments. In this case, joint 246 is shown with a tongue-and-groove configuration having a tongue 250 on deck portion 252 of module 242 extending into a groove 254 and a deck portion 256 of module 244. Both sides of this tongue-and-groove joint 246 are coated with an epoxy adhesive 258. It should be understood that the tongue-and-groove arrangement illustrated for third embodiment 240 could be applied to first embodiment 90 and second embodiment 160 as well.

Module 242 has a longitudinally extending beam or steel member, preferably in the form of a longitudinal tube 260 which is connected to deck portion 252 by a plurality of shear connectors 262. Similarly, module 244 has a longitudinally extending tube 264 attached to deck portion 256 by a plurality of shear connectors 266.

A small transversely disposed tube 268 is positioned adjacent to longitudinal tube 260 and preferably attached thereto, such as by welding. Transverse tube 268 is connected to deck portion 252 by a plurality of shear connectors 270 and has a closure plate attached to the open end as by welding. A similar transverse tube 272 is attached to longitudinal tube 264 of module 144 and to deck portion 256 thereof by a plurality of shear connectors 274.

After modules 242 and 244 are positioned on girder 248, leveling bolts 278 are used to level upper surfaces 280 of module 242 and upper surface 282 of module 244 in a manner previously described for the other embodiments. This will raise lower surfaces 284 and 286 of modules 280 and 282, respectively, such that a gap 288 is defined between the lower surfaces and upper flange 290 of girder 248. Leveling bolts 278 may be disposed in threaded inserts (not shown) as previously described.

After leveling, precompression may be provided by an all-thread rod 276 which extends through transverse tube 268, longitudinal tube 260, through a hole 292 drilled in girder 248, longitudinal tube 264 and transverse tube 272, along with nuts 280 and 282 which engage the all-thread rod. By tightening on either of nuts 280 or 282, modules 242 and 244 are forced toward one another, compressing epoxy adhesive 254 in joint 246 in a manner similar to that previously described.

Gap 288 is sealed by a pair of seals, such as foam backer rods 294, disposed between tube 260 and upper flange 290 and between tube 264 and upper flange 290. High-strength grout is then poured into gap 288 through grouting openings 296.

Referring now to FIG. 9, a shear connection is made between girder 248 and deck portion 252 of module 242 and deck portion 256 of module 244 by epoxy-drilled bolts 298 drilled through upper flange 290 of girder 248 and into deck portions 252 and 256. After this, all-thread rod 276 and nuts 280 and 282 may be removed.

At shear connections made at longitudinal locations where there was no precompression applied by all-thread rod 276 and nuts 280 and 282, the shear connection will look exactly the same as in FIG. 9.

While third embodiment 240 has the advantage of a more simplified construction in that it does not use flat or angled members to make a shear connection between the girder and the modules, it does have the disadvantage that in some cases, epoxy-drilled bolts are difficult to remove in the event of later repair or replacement of the entire structure. That is, third embodiment 240 may have initially lower materials costs, but it may require more labor to remove epoxy seal bolts 298 than to simply unbolt the components in first embodiment 90 and second embodiment 160, making it easier for repair and replacement later. Each of the embodiments, however, has distinct advantages depending upon the circumstances of the construction.

Transverse Joints

Referring now to FIG. 10, the connection of adjacent modules at transverse joints 42 is shown. For example, the connection at transverse joint 42 between modules 26 and 34 is illustrated for first embodiment structure 90, and in fact would be identical for second embodiment 160 and third embodiment 240 as well.

As previously described, module 26 has a deck portion 52 with a longitudinal tube 102 attached thereto. Similarly, module 34 may be described as having a deck portion 252 with a longitudinally extending tube 302 thereon. Making the transverse connection between modules 26 and 34 is considerably more simple than the longitudinal connections previously described. Joint 42 is preferably a tongue-and-groove joint with a tongue 304 on module 26 extending into a groove 306 defined in module 34. Both faces of joint 42 are coated with an epoxy adhesive 308.

An angled member 310 is attached to tube 102 adjacent to joint 42, and another angled member 310 is attached to tube 302 adjacent to the joint. The pair of angled members 310 are interconnected by a bolt engaged by a nut 314. By tightening this threaded connection, module 34 is moved toward module 26, assuming that module 26 has already been permanently installed on the girders as previously described. This compresses sealant 308 in joint 42 so that a tight, waterproof connection is made.

Fourth Embodiment

The previously described embodiments show the structure of the present invention where steel girders are used. However, the modular construction and repair system can also be adapted for bridges utilizing concrete girders, and there are many such bridges in service.

Figure 12:
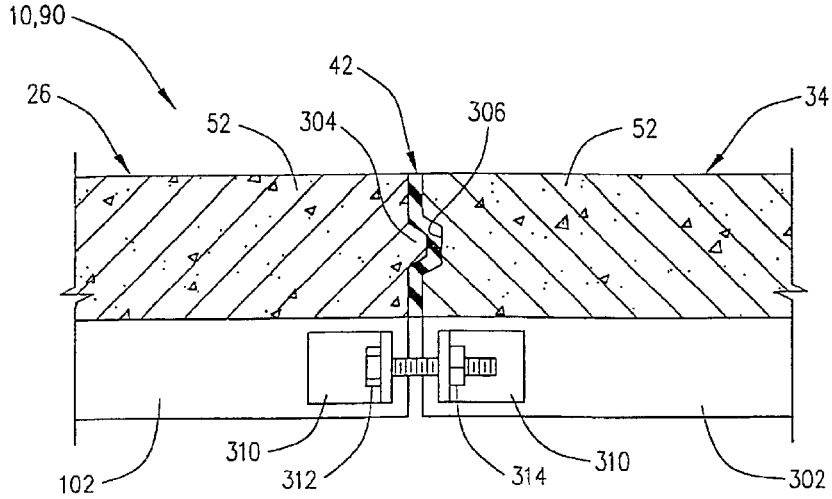
FIG. 12 shows a cross-section of the fourth embodiment taken along lines 5—5 in FIG. 1.

Referring to FIGS. 11 and 12, a fourth embodiment is shown and generally designated by the numeral 320 which includes a plurality of concrete girders 322. As illustrated in FIGS. 11 and 12, fourth embodiment bridge 320 comprises modules 324 and 326 which are installed on an enlarged upper flange portion 328 of one of girders 322.

Each of modules 324 and 326 has a plurality of longitudinally spaced leveling bolts 330, and each module defines a plurality of longitudinally spaced grouting openings 332 defined therein. Leveling bolts 330 may be disposed in threaded inserts (not shown) as previously described.

Similar to the previously described embodiments, module 324 has a longitudinally extending beam or steel member, preferably in the form of a longitudinal tube 334, attached to deck portion 336 by a plurality of shear connectors 338. Similarly, module 326 has a longitudinally extending beam or steel member, preferably in the form of a longitudinal tube 340, attached to a deck portion 342 by a plurality of shear connectors 344.

An angled member 346 is attached to tube 334 by a fastening means, such as a threaded welded stud 348 and a nut 350. Angled member 346 is connected to upper flange 328 of girder 322 by an all-thread rod 352 threadingly engaged with a threaded insert 354 in upper flange 328. All-thread rod 352 is engaged by a nut 356 to complete the connection. To facilitate connection between angled member 346 and tube 334, the vertical leg of angle 346 has a vertical slot 357 for all-thread rod 352. Threaded insert 354 may be cast in new girders 322 or installed in old girders. Also, all-thread rod 353, threaded insert 354 and nut 356 may be replaced by an epoxy-drilled bolt.

A short, transversely extending tube 358 is positioned adjacent to tube 340 and preferably attached thereto, such as by welding. Short tube 186 is connected to deck portion 342 of module 326 by a plurality of shear connectors 360. Short tube 358 has an angled member 362 fixedly attached thereto, such as by welding, and has its open end closed with a closure plate 359.

A precompression connection is made between girder 322 and module 326 by an all-thread rod 364 and a nut 366 which is used to interconnect angled member 362 and upper flange 328 of girder 322. A threaded insert 368 is engaged by all-thread rod 364. Threaded insert 368 may be cast into a pre-cast girder 322 or subsequently installed in a pre-existing girder. As seen in the right side of FIG. 11, by tightening nut 366, module 326 is moved toward module 324, closing a joint 370 defined therebetween. As with the other embodiments, both sides of joint 370 are coated with an epoxy adhesive 372.

Once this precompression is completed, a seal, such as a foam backer rod 374 is disposed between longitudinal tube 334 and flange 328 of girder 322 and also between longitudinal tube 340 and upper flange 328 to sealingly close a gap 376 defined between deck portions 336 and 342 and girder 332 spaced therebelow. High-strength grouting material is poured into gap 376 through grouting openings 332 and allowed to harden. Leveling bolts 330 are removed and the remaining threaded openings also filled with grout.

Referring now to FIG. 12, shear connections are illustrated between girder 322 and modules 324 and 326 at a location spaced away from the precompression assembly shown in FIG. 11. The connection of module 324 to girder 322 at this location is identical to that shown in FIG. 11. In FIG. 12, the connection of module 326 to girder 322 at that location is simply a mirror image of that for module 324. That is, another angled member 378 is used to connect longitudinal tube 340 to upper flange 328 of girder 322. One leg of angled member 378 is attached to tube 340 by a bolt 380 engaging a threaded welded stud 381, and the other leg of angled member 378 is connected to upper flange 328 by an all-thread rod 382 and nut 384. All-thread rod 382 is engaged with a threaded insert 368 which is cast in or later installed in girder 322. Alternatively, an epoxy-drilled bolt may be used instead of all-thread rod 382, nut 384 and threaded insert 386.

Figure 13:
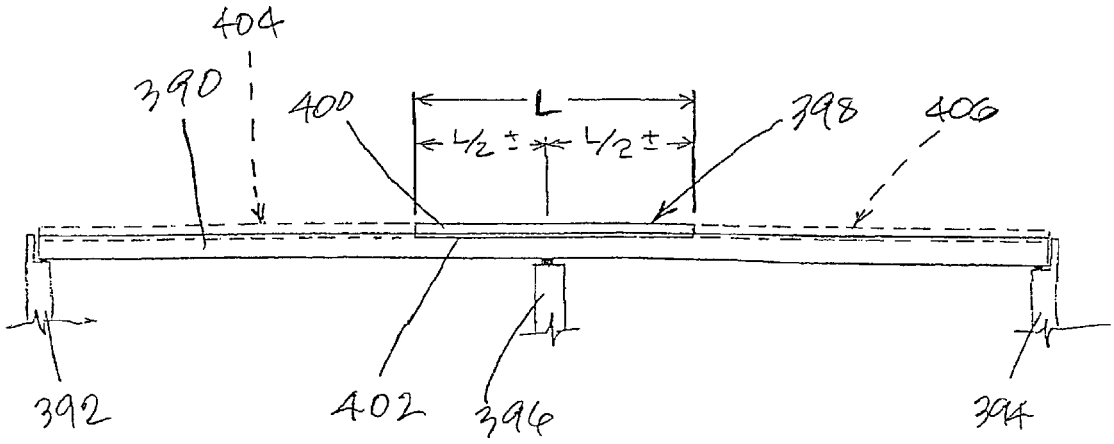

Referring now to FIG. 13, a continuous girder 390 is shown disposed on structural supports, such as abutments 392 and 394 and a central pier 396. A module 398 of the kind previously described comprising a deck portion 400 and a plurality of longitudinally extending beams 402 is centrally disposed over pier 396. Normally, this would result in tension being applied to the concrete in the upper surface of deck portion 400 which is not desirable in bridge construction. However, when module 398 is formed in an inverted position, there is sufficient precompression provided to deck portion 400 that, when the module is placed in the upright position shown in FIG. 13, compressive stresses created thereon exceed any tensile stresses that could come to that location. Therefore, the structural properties of girder 390 plus module 398 become composites which exceed the non-composite properties of the girder alone.

Additional modules 404 and 406 may be subsequently positioned on girder 390. Once all of the modules are in their proper locations as shown in FIG. 13, the shear connections, previously described, between beams 402 and girder 390 are made.

It will be seen, therefore, that the modular bridge connection and repair system of the present invention is well adapted to carry out the ends and advantages mentioned, as well as those inherent therein. While three presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A structural member for use on a structural support, said member comprising:

a plurality of longitudinally extending girders;

a plurality of longitudinally extending composite beam and deck modules, each module comprising:

a plurality of longitudinal beams extending parallel to said girders, said beams being disposed to a side of said girders and below a top portion of said girders;

a plurality of shear connectors permanently attached to a top portion of said beams; and a deck portion made of a moldable material disposed above said beams, said deck portion being permanently attached to said beams when the moldable material is hardened around said shear connectors such that a shear connection is formed therebetween, wherein longitudinally extending separated sides of adjacent deck portions face one another and are positioned above a corresponding one of said girders; and connecting means for connecting said adjacent deck portions to said girders and thereby forming a shear connection therebetween.

2. The member of claim 1 further comprising an adhesive disposed between said sides of adjacent deck portions.

3. The member of claim 2 wherein said adhesive is an epoxy adhesive.

4. The member of claim 1 wherein one of said sides defines a longitudinally extending groove therein.

5. The member of claim 4 wherein the other of said sides has a tongue portion thereon adapted for extending into said groove such that upper surfaces of said deck portions of said adjacent composite members are held substantially aligned.

6. The member of claim 1 wherein said beams are characterized by tubes.

7. The member of claim 1 further comprising leveling means for leveling upper surfaces of said deck portions.

8. The member of claim 7 wherein said leveling means is characterized by a bolt engaged with said deck portion and adapted for engaging said girder whereby said deck portion may be raised above said girder such that a vertical gap is defined between a bottom portion of said deck portion and a top portion of said girder.

9. The member of claim 8 wherein said bolt is threadingly engaged with an insert disposed in said deck portion.

10. The member of claim 8 wherein said deck portion defines a grouting opening through which grout may be poured to fill said gap.

11. The member of claim 10 wherein said horizontal gap is defined between said girder and beams; and further comprising:

a seal disposed in said horizontal gap for substantially sealing and closing said horizontal gap; and grout poured in said vertical gap.

12. The member of claim 1 wherein said connecting means comprises:

a plate disposed adjacent to said girder and one of said beams; and fastening means for attaching said plate to said beam and said girder.

13. The member of claim 12 wherein:

said plate is characterized by an angled member having a pair of legs; and said fastening means comprises a fastener interconnecting one of said legs and said tube and another fastener interconnecting the other of said leg and a flange of said girder.

14. The member of claim 12 wherein:

said plate is substantially flat; and said fastening means is characterized by a fastener interconnecting said plate and said tube and another fastener interconnecting said plate and said girder.

15. The member of claim 14 further comprising a spacer disposed between said plate and said flange of said girder.

16. The member of claim 1 wherein said connecting means comprises:

a plurality of bolts extending through a flange of said girder into said deck portion.

17. The member of claim 16 wherein said bolts are epoxy-drilled bolts.

18. The member of claim 1 further comprising:

precompression means for clamping said sides of said adjacent deck portions together.

19. The member of claim 18 wherein said precompression means comprises:

a plate attached to said girder;

a short tube disposed horizontally adjacent to one of said longitudinal tubes such that an end of said short tube abuts a wall of said longitudinal tube;

a plurality of short-tube shear connectors attached to a top portion of said short tube such that said short tube is attached to said deck portion when the moldable material is hardened around said short-tube shear connectors; and a fastener adapted for tightening and interconnecting said plate and said short tube.

20. The member of claim 19 wherein:

said plate is an angled member having a pair of legs; and said fastener extends through one of said legs.

21. The member of claim 20 wherein said short tube is substantially perpendicular to said longitudinal tube.

22. The member of claim 21 further comprising a closure plate attached to said short tube.

23. The member of claim 20 further comprising:

another angled member having a pair of legs, one of said legs on the other angled member being attached to said short tube;

wherein, said fastener is attached to the other of said legs on the first-mentioned angled member and the other of said legs on the other angled member.

24. The member of claim 23 wherein said short tube is disposed transversely with respect to said longitudinal tubes.

25. The member of claim 18 wherein said precompression means comprises:

short tubes adjacent to longitudinal tubes on opposite sides of a corresponding girder and connected to said deck portion; and a fastener disposed through said short tubes, said longitudinal tubes and a hole defined in said girder.

26. The member of claim 25 wherein said short tube extends transversely with respect to said longitudinal tubes.

27. The member of claim 25 further comprising a closure plate attached to an end of said short tube.

28. The member of claim 1 wherein said girder is concrete and has upper and lower flanges molded therein.

29. The member of claim 28 wherein said connecting means comprises:

a plate disposed adjacent to said girder and below a top portion of said girder and adjacent to and below a bottom portion of one of said beams; and fastening means for attaching said plate to said beam and said girder.

30. The member of claim 29 wherein:

said plate is characterized by an angled member having a pair of legs; and said fastening means comprises a fastener adapted for tightening and interconnecting one of said legs and said tube and another fastener interconnecting the other of said legs and said upper flange of said girder.

31. The member of claim 30 wherein said fastener is a bolt engaged with an insert disposed in said upper flange of said girder.

32. The member of claim 31 wherein said insert is cast in said flange during manufacture of said girder.

33. The member of claim 30 wherein said bolt is an epoxy-drilled bolt.

34. The member of claim 28 further comprising:

precompression means for clamping said sides of said adjacent deck portions together.

35. The member of claim 34 wherein said precompression means comprises:

a short tube disposed adjacent to one of said longitudinal tubes and connected to said deck portion;

a plate attached to said short tube; and a fastener interconnecting said plate and said girder.

36. The member of claim 31 wherein:

said plate is an angled member having a pair of legs, one of said legs being attached to said short tube; and said fastener comprises an all-thread rod engaged with an upper flange of said girder and a nut threadingly engaged with said all-thread rod and further engaged with the other leg of said angled member.

37. The member of claim 36 wherein said all-thread rod is threadingly engaged with an insert disposed in said upper flange of said girder.

38. The member of claim 37 wherein said insert is cast in said girder during manufacture thereof.

39. The member of claim 35 wherein:

said plate is an angled member having a pair of legs, one of said legs being attached to said short tube; and said fastener is an epoxy-drilled bolt extending through the other of said legs of said angled member and engaging said upper flange of said girder.

40. The member of claim 1 further comprising:

transverse connecting means for connecting transversely extending sides of facing deck portions of adjacent modules to form a transverse joint therebetween.

41. The member of claim 40 wherein said transverse connecting means comprises:

a plate disposed on one of adjacent beams of said adjacent modules; and another plate disposed on the other of said adjacent beams of said adjacent modules; and fastening means for interconnecting said plates.

42. The member of claim 41 wherein:

said plates are angled members; and said fastening means comprises a bolt disposed through facing legs of said angled members.

43. The member of claim 40 further comprising an adhesive disposed between said transversely extending sides of said facing deck portions.

44. The member of claim 43 wherein said adhesive is an epoxy adhesive.

45. The member of claim 40 wherein one of said transversely extending sides defines a transversely extending groove therein.

46. The member of claim 45 wherein:

the other of said transversely extending sides has a tongue portion thereon adapted for extending into said groove such that upper surfaces of said deck portions of said adjacent composite members are held substantially aligned.

47. A structural member for use on a structural support, said member comprising:

a longitudinally extending girder;

a longitudinally extending composite beam and deck module, each module comprising:

a plurality of longitudinal beams extending parallel to one another and to said girder, said beams being disposed to a side of said girders and below a top portion of said girders;

a plurality of shear connectors permanently attached to a top portion of said beams; and a deck portion made of a moldable material permanently attached to said beams when the moldable material is hardened around said shear connectors such that a shear connection is formed therebetween, wherein one of said beams is disposed on opposite sides of said girder; and connecting means for connecting said deck portion to said girder and thereby forming a shear connection therebetween.

48. The member of claim 47 wherein said connecting means comprises:

a plate disposed adjacent to one of said beams and said girder;

another plate disposed adjacent to the other of said beams and said girder; and fastening means for connecting said plates to said girder and the corresponding longitudinal beams.

49. The member of claim 48 wherein said plates are angled members having a pair of legs, one leg engaging the corresponding longitudinal tube and the other leg engaging a flange of said beam.

50. The member of claim 47 further comprising leveling means for leveling an upper surface of said deck portion.

51. The member of claim 50 wherein said leveling means comprises a bolt threadingly engaged in said deck portion and engaging an upper surface of said girder such that said deck portion may be raised above said girder such that a vertical gap is defined between a bottom portion of said deck portion and a top portion of said girder.

52. The member of claim 51 wherein said deck portion defines a grouting opening through which grout may be poured to fill said vertical gap.

53. The member of claim 52 wherein said horizontal gap is defined between said girder and beams; and further comprising:

a seal disposed in said horizontal gap for substantially sealing and closing said horizontal gap; and grout poured in said vertical gap.

54. A method of repairing a bridge structure having a bridge deck supported by a plurality of longitudinally extending girders comprising the steps of:

(a) prefabricating a plurality of longitudinally extending beam and deck composite modules, each module comprising:

a plurality of substantially parallel longitudinal beams, said beams being disposed to a side of said girders and below a top portion of said girders;

a plurality of shear connectors permanently attached to a top portion of said beams; and a deck portion made of a moldable material and attached to said beams when the moldable material is hardened around said shear connectors, such that a shear connection is formed therebetween;

(b) removing an old section of said bridge deck from an area above one of the girders while leaving the girder in place;

(c) positioning at least one of said modules in said area to replace said old section such that said beams extend longitudinally and substantially parallel to said girder; and (d) clamping facing longitudinal sides of adjacent deck portions of adjacent modules together such that a longitudinally continuous and precompressed, sealed joint is formed between said adjacent deck portions.

55. The method of claim 54 wherein step (a) comprises prefabricating said modules in an inverted position.

56. The method of claim 54 further comprising:

prior to step (d), placing an adhesive between said facing longitudinal sides of said adjacent deck portions.

57. The method of claim 54 wherein step (a) comprises:

forming one of said deck portions with a longitudinally extending groove defined in a side thereof and another deck portion with a tongue thereon adapted for extending into the groove after step (d) such that upper surfaces of said adjacent deck portions are held substantially aligned.

58. The method of claim 57 further comprising:

prior to step (d), placing an adhesive in said groove.

59. The method of claim 54 wherein:

step (a) comprises fabricating said deck portions with a plurality of leveling bolts disposed therein such that said leveling bolts are adapted for engaging an upper surface of said girder when said deck portions are placed in said area; and further comprising, prior to step (b), using said bolts to level upper surfaces of said deck portions such that all of said deck portions are substantially aligned.

60. The method of claim 59 wherein:

step (a) comprises casting threaded inserts in said deck portions, said threaded inserts being engaged by said leveling bolts.

61. The method of claim 59 wherein:

said step of leveling causes a vertical gap defined between a bottom portion of said adjacent deck portions and a top portion of the corresponding girder; and step (a) comprises fabricating said deck portions with a plurality of grouting openings therein through which grout may be poured to fill said vertical gap;

and further comprising:

(e) filling said vertical gap with a high-strength grout through said grouting-openings.

62. The method of claim 61 further comprising:

prior to step (e), sealing and closing a horizontal gap between said girder and said beams adjacent thereto.

63. The method of claim 54 further comprising:

(e) attaching adjacent longitudinal beams of adjacent modules along a transverse joint therebetween.

64. The method of claim 54 further comprising:

(f) connecting said beams to said girder such that a shear connection is formed therebetween.

* * * * *

UNITED STATES PATENT AND TRADEMARK OFFICE

CERTIFICATE OF CORRECTION

PATENT NO. : 6,857,156 B1
DATED : February 22, 2005
INVENTOR(S) : Stanley J. Grossman It is certified that error appears in the above-identified patent and that said Letters Patent is hereby corrected as shown below:

Title page,
Item [57], ABSTRACT,
Line 1, after "modular" and before "structure," insert -- bridge --.
Line 7, delete "girder" and insert -- girders -- therefor.

Column 3,
Line 6, delete the hyphen after "piece."

Column 6,
Line 10, insert -- FIG. 13 illustrates assembly of modules on a continuous girder disposed on structural supports. --
Line 27, delete "I-bean" and insert -- I-beam -- therefor.

Column 18,
Line 54, delete the hyphen after "grouting" and before "openings."

Signed and Sealed this

Twenty-fourth Day of May, 2005

JON W. DUDAS
*Director of the United States Patent and Trademark Office*